US007406811B2

(12) United States Patent
Fresnel

(10) Patent No.: US 7,406,811 B2
(45) Date of Patent: Aug. 5, 2008

(54) METHOD OF PACKAGING ARTICLES BY MEANS OF HEAT-SHRINK SLEEVES

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 25 days.

(21) Appl. No.: 11/317,299

(22) Filed: Dec. 23, 2005

(65) Prior Publication Data

US 2006/0157369 A1 Jul. 20, 2006

(30) Foreign Application Priority Data

Dec. 30, 2004 (FR) ..... 04 14073

(51) Int. Cl.
*B65B 61/20* (2006.01)
*B65B 53/06* (2006.01)

(52) U.S. Cl. ..... 53/415; 53/442; 53/449

(58) Field of Classification Search ..... 53/442, 53/415, 449, 135.1, 170, 557
See application file for complete search history.

(56) References Cited

U.S. PATENT DOCUMENTS

| | | | | | |
|---|---|---|---|---|---|
| 3,110,554 | A * | 11/1963 | Yazumi | 53/399 |
| 3,541,753 | A * | 11/1970 | Katz | 53/442 |
| 3,542,229 | A | 11/1970 | Beyerlein et al. | 215/1 |
| 3,896,604 | A * | 7/1975 | Marantz | 53/176 |
| 3,969,173 | A * | 7/1976 | Amberg et al. | 156/218 |
| 3,999,357 | A * | 12/1976 | Marantz | 53/442 |
| 4,069,934 | A | 1/1978 | Karabedian | 215/12 |
| 4,190,168 | A | 2/1980 | Jacques | 215/12 |
| 4,205,750 | A * | 6/1980 | Dews | 206/534 |
| 4,587,857 | A * | 5/1986 | Bush | 73/863 |
| 4,604,307 | A * | 8/1986 | Spreeuwers | 428/34.2 |
| 4,690,843 | A | 9/1987 | Inagaki | |
| 4,724,973 | A * | 2/1988 | Shah | 215/246 |
| 4,745,014 | A * | 5/1988 | Hanaya et al. | 428/34.9 |
| 6,020,823 | A | 2/2000 | DeCicco | |
| 6,254,139 | B1 * | 7/2001 | Fresnel | 283/94 |
| 6,343,456 | B2 * | 2/2002 | Weder | 53/397 |
| 2003/0021918 | A1 | 1/2003 | McKillip | 428/34.1 |

(Continued)

FOREIGN PATENT DOCUMENTS

DE 1 607 932 8/1970

(Continued)

OTHER PUBLICATIONS

International Search Report, dated Oct. 7, 2003.

*Primary Examiner*—Stephen F Gerrity
(74) *Attorney, Agent, or Firm*—McCormick, Paulding & Huber LLP

(57) ABSTRACT

The invention provides a method of packaging one or more articles, the method comprising the steps consisting in:

a) putting a first sleeve of heat-shrink material into place on the article(s) to be packaged;

b) using a thermal process to shrink the first sleeve onto said article(s);

c) putting a second sleeve of heat-shrink plastics material on the article(s) covered in said shrunk-on first sleeve; and d) using a thermal process to heat the wall of the shrunk-on first sleeve in order to obtain thermal equilibrium with the wall of the second sleeve as put into place, and then shrinking said second sleeve onto said first sleeve.

The invention also provides a wrapper for packaging one or more articles, the wrapper comprising two superposed sleeves of heat-shrink plastics material.

9 Claims, 2 Drawing Sheets

U.S. PATENT DOCUMENTS

2003/0068453 A1 4/2003 Kong ..... 428/35.2
2005/0229542 A1 * 10/2005 Fresnel ..... 53/397

FOREIGN PATENT DOCUMENTS

EP 0537455 A1 4/1993
FR 1 598 447 8/1970
FR 2841224 * 6/2002

* cited by examiner

METHOD OF PACKAGING ARTICLES BY MEANS OF HEAT-SHRINK SLEEVES

CROSS-REFERENCE TO RELATED APPLICATIONS

Applicant hereby claims foreign priority benefits under U.S.C. § 119 from French Patent Application No. 0414073 filed on Dec. 30, 2004, the contents of which are incorporated by reference herein.

FIELD OF THE INVENTION

The present invention relates to packaging articles by means of heat-shrink sleeves.

BACKGROUND OF THE INVENTION

The technique of making sleeves of a heat-shrink plastics material and of shrinking them onto one or more articles became available about 30 years ago.

In order to control the process of shrinking a heat-shrink sleeve onto an article, it was found that thermal questions played a considerable role, and that in particular it was found that any temperature gradient between the inside and outside faces of the film for shrinking degraded the quality of the shrinking of the sleeve on the article. Steps were then taken to organize prior heating of the sleeve for shrinking so as to establish a uniform temperature through the wall of the sleeve and avoid as much as possible any influence from the outside face of the article to be wrapped. The Applicant has in particular made proposals for blowing air between the inside face of the sleeve and the outside face of the article, the blanket of air thus provided serving to establish optimum thermal conditions through the thickness of the wall of the sleeve for shrinking at the time when said wall reaches the softening temperature of the heat-shrink film constituting said sleeve.

Those shrinking techniques are nowadays thoroughly mastered and have given rise to numerous patent applications by the Applicant.

The articles that are packaged by such packaging techniques using heat-shrink sleeves are frequently containers. When they are bottles, in particular glass bottles, present techniques are not completely satisfactory, particularly if the bottles already contain the associated liquid, since the article to be wrapped constitutes a thermal barrier that is very restricting during the process of shrinking the sleeve. It will readily be understood that heating the glass wall, as is necessary for achieving temperature equilibrium on reaching the softening temperature of the film, is not generally compatible with the nature of the liquid. This applies in particular when the liquid is a fizzy or highly carbonated beverage. This problem of a thermal nature arises more generally whenever the container is cold, regardless of whether it is full or empty.

That is why, until now, heat-shrink sleeve means have not been used for packaging bottles that are very cold and/or full, in particular glass bottles containing gassy liquids such as mineral waters or sparkling wines.

The state of the art is also illustrated by the documents mentioned below.

Document U.S. Pat. No. 3,110,554 illustrates covering a metal food can in order to provide it with durable labeling. To do that, a heat-shrink sleeve is put into place on a can and the can-and-sleeve assembly is raised to a temperature of about 85° C. for three to six minutes, thereby simultaneously sterilizing the food contained in the can and shrinking the sleeve onto said can, said sleeve having as its main function protecting the can against corrosion, in particular at the bonding seam line. In a variant, a first sleeve with printing on its outside face is formed on the can, then the can is filled, sealed, and sterilized, and a second sleeve constituting an outer protective sleeve that is identical to the first is put into place and shrunk by subjecting the can and both sleeves to a temperature of 90° C. for five minutes. Such a technique makes use of thermal processes of long duration and remains restricted to metal food cans.

Document DE-A-16 07 932 describes making a belt out of one or two layers, which, on being shrunk onto a thin-walled receptacle of synthetic material, creates prestress that opposes the stress to which the wall of the receptacle will be subjected under the effect of pressure from its content, thereby preventing it from rupturing under the effect of internal pressure. The function provided by the one-or two-layer belt is a hooping function specific to the field of synthetic material bottles containing liquids under pressure.

Document U.S. Pat. No. 4,190,168 and U.S. Pat. No. 4,069,934 describe shrinkable sleeves having two stuck-together layers, which are thus shrunk as a single layer.

Document US-A- 2003/0068453 also describes a multilayer heat-shrink sleeve.

Finally, document US-A-2003/0021918 describes a heat-shrink sleeve having a wall that is coated internally with a layer of varnish and a metallized layer.

BRIEF SUMMARY OF THE INVENTION

An object of the invention is to provide a technique of packaging articles by means of heat-shrink sleeves that avoids the drawbacks and limitations mentioned above while nevertheless remaining compatible with individual shrinking machines or with existing equipment for shrinking sleeves based on articles traveling continuously.

Another object of the invention is to provide a technique for packaging articles using heat-shrink sleeves that can also be used with containers that are cold and/or full.

According to the invention, the above-specified technical problem is solved by a method of packaging one or more articles, the method comprising the steps consisting in:

putting a first sleeve of heat-shrink material into place on the article(s) to be packaged;

using a thermal process to shrink the first sleeve onto said article(s);

putting a second sleeve of heat-shrink plastics material on the article(s) covered in said shrunk-on first sleeve; and using a thermal process to heat the wall of the shrunk-on first sleeve in order to obtain thermal equilibrium with the wall of the second sleeve as put into place, and then shrinking said second sleeve onto said first sleeve.

Thus, when it comes to shrinking the second sleeve, heating the article for wrapping amounts to heating only the wall of the first sleeve that has already been shrunk on the article, thus making it possible to obtain heating very quickly for the purpose of achieving the desired thermal equilibrium without it being necessary to suffer from the thermal barrier represented by the article. It then becomes possible to envisage using specific sleeves as second sleeves, in particular sleeves of a plastics material that is fragile and thin, which could not be envisaged with conventional techniques using only a single heat-shrink sleeve. In addition, it is now possible to cover containers that are cold and/or full, and in particular ready for immediate consumption.

In an advantageous implementation, the method of the invention includes an intermediate step e) between above-specified steps b) and c), the intermediate step consisting in putting a functional element into place against the outside face of the first sleeve shrunk onto said article(s), said functional elements then being covered by the second sleeve.

Provision can then be made for the first sleeve used during step a) to be previously deformed locally by an embossing process so as to have a predetermined pattern in association with the shape of the functional element, said embossing process being such that said pattern appears in relief on the outside face of the first sleeve and remains after said first sleeve has been shrunk. In particular, the embossed pattern is arranged to form a housing for encapsulating the functional element.

Also advantageously, the functional element is held at least temporarily by being stuck against the outside face of the first sleeve before the second sleeve is put into place, with said functional element being held finally in place by the subsequent shrinking of said second sleeve.

The invention also provides a wrapper for packaging one or more articles, which wrapper is remarkable in that it comprises a first sleeve of heat-shrink plastics material for shrinking onto the article(s) for packaging, and a second sleeve of heat-shrink plastics material for shrinking onto said article(s) covered in the shrunk-on first sleeve, after prior heating of said first sleeve in order to obtain thermal equilibrium with the wall of said second sleeve.

Preferably, the first sleeve and the second sleeve have axial heights that are substantially identical. Thus, thermal equilibrium can be achieved over the entire height of the second sleeve before shrinking it, thereby also avoiding differences in level that could be unsightly.

Provision can be made for the first sleeve and the second sleeve to differ from each other in the thickness and/or the nature of their constituent films, or in a variant the first sleeve and the second sleeve can be made from constituent films of the same nature and the same thickness.

Preferably, the first sleeve is printed to present printing of a technological nature relating to the identification and/or traceability of the articles concerned, and the second sleeve is printed to present printing of a decorative nature, but without interfering with the legibility of the printing of the first sleeve.

In an advantageous embodiment, the packaging wrapper includes a functional element disposed between the first and second sleeves.

Provision can then be made for the functional element to be an antitheft security element or an anti-tampering element, or in a variant an identification or an encoding element, or indeed a coin or a medal.

Provision can then be made for the functional element to be stuck against the outside face of the first sleeve.

In a variant, it could be advantageous for the first sleeve to present an embossed portion forming the pattern in relief on the outside face of said first sleeve, said pattern being arranged in association with the shape of the functional element. In which case it is preferable for the stamped pattern to be arranged to form a housing for encapsulating the functional element.

Provision can then be made for the first sleeve to present a position-identifying pattern, in particular colored dots, for facilitating circumferential positioning of the second sleeve relative to the first sleeve, or in a variant the first sleeve and the second sleeve may present matching embossing, in particular forming male-female engagement once the second sleeve has been shrunk onto the first sleeve so as to provide circumferential indexing of said second sleeve relative to said first sleeve.

It can also be advantageous to provide for the second sleeve to present a tear strip arranged axially or circumferentially in order to enable said second sleeve to be removed, thereby giving access to the functional element.

To further reinforce the security aspects of the package, provision can be made for at least one of the first and second sleeves to present optical effects, in particular holographic effects.

Finally, it is advantageous for the first sleeve to be made from a multilayer film, while the second sleeve is made from a single layer film, or vice versa. In particular, provision can be then be made for the multilayer film to have at least three layers, with a central layer presenting barrier properties, in particular thermal barrier properties.

Other characteristics and advantages of the invention appear more clearly in the light of the following description and the accompanying drawings.

BRIEF DESCRIPTION OF THE DRAWINGS

Reference is made to the figures of the accompanying drawings, in which.

DETAILED DESCRIPTION OF THE INVENTION

Figure 1:
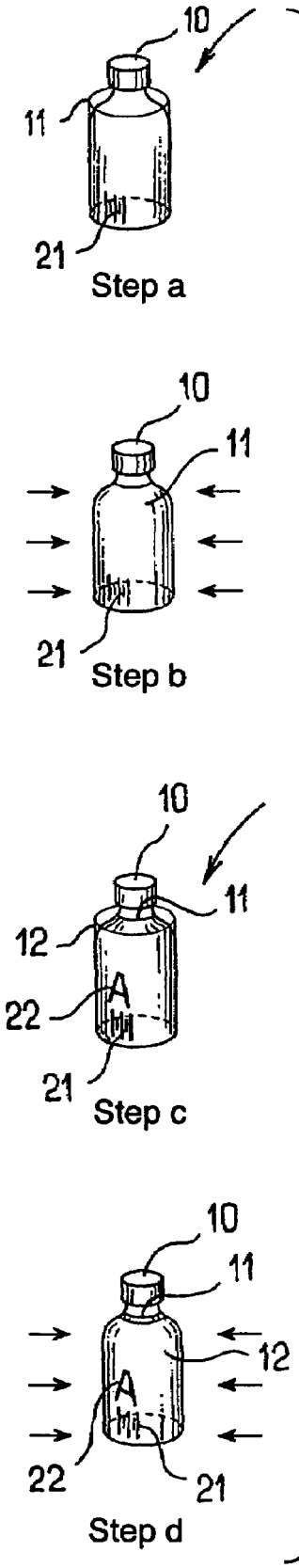
FIG. 1 is a diagram showing the successive steps in the method of the invention.

FIG. 1 is a diagram of the steps of a method of the invention for packaging articles.

This figure shows a single article being packaged, but the invention is naturally not limited in any way to such an application, and it is entirely possible to provide a group of articles onto which a first and then a second sleeve of heat-shrink plastics material are put into place. In that technique, which has already been used for packaging a group of articles but using a single heat-shrink sleeve, the shrinking of each sleeve also provides a mechanical function of clamping and holding the articles together.

In step a), an article 10, represented as a container, has a first sleeve 11 of heat-shrink plastics material put into place thereover.

In step b), the first sleeve 11 engaged on the article 10 is shrunk by a thermal process. This shrinking process uses hot air or steam, as appropriate, as represented by arrows. It would also be possible to blow air by means of nozzles (not shown) between the article 10 and the inside face of the sleeve 11 around the article.

So far the method is very similar to conventional packaging methods using heat-shrink sleeves, except insofar as the sleeve 11 constituting a first sleeve can present particular characteristics, as explained below.

In step c), a second sleeve 12 of heat-shrink plastics material is put into place over the article already wrapped in the shrunk-on first sleeve 11.

In step d), a thermal process is used to heat the wall of the shrunk-on first sleeve 11, and when thermal equilibrium is reached with the wall of the second sleeve 12 placed thereabout, said second sleeve 12 is shrunk onto the article already wrapped in said shrunk-on sleeve 11. Here again, the thermal process is represented by arrows. The second sleeve 12 is shrunk on easily and very quickly insofar as the wall of this second sleeve 12 heats up almost instantaneously since the heating of the internal article for wrapping amounts to no more than heating the wall of the first sleeve 11, without it being necessary to wait for the wall of the article itself to be heated sufficiently.

For the steps a) and c) of putting the first and second sleeves 11 and 12 into place, this can be done automatically when using a machine that includes a system for causing articles to travel continuously, with passes through a shrinkage tunnel, as is well known to the person skilled in the art. In a variant, if a machine is used that is adapted to shrink a sleeve onto a single article, i.e. to perform individual shrinking, then an operator can put the first and second sleeves 11 and 12 into place manually.

Although the main looked-for technical effect when using a second sleeve shrunk onto a first sleeve that has already been shrunk on is obtaining thermal equilibrium, in particular when packaging glass bottles that are cold and/or full, it can be advantageous to take advantage of the presence of the second sleeve and of its shrinking in order to perform an additional function of covering and holding in place an intermediate element sandwiched between the two sleeves.

Figure 2:
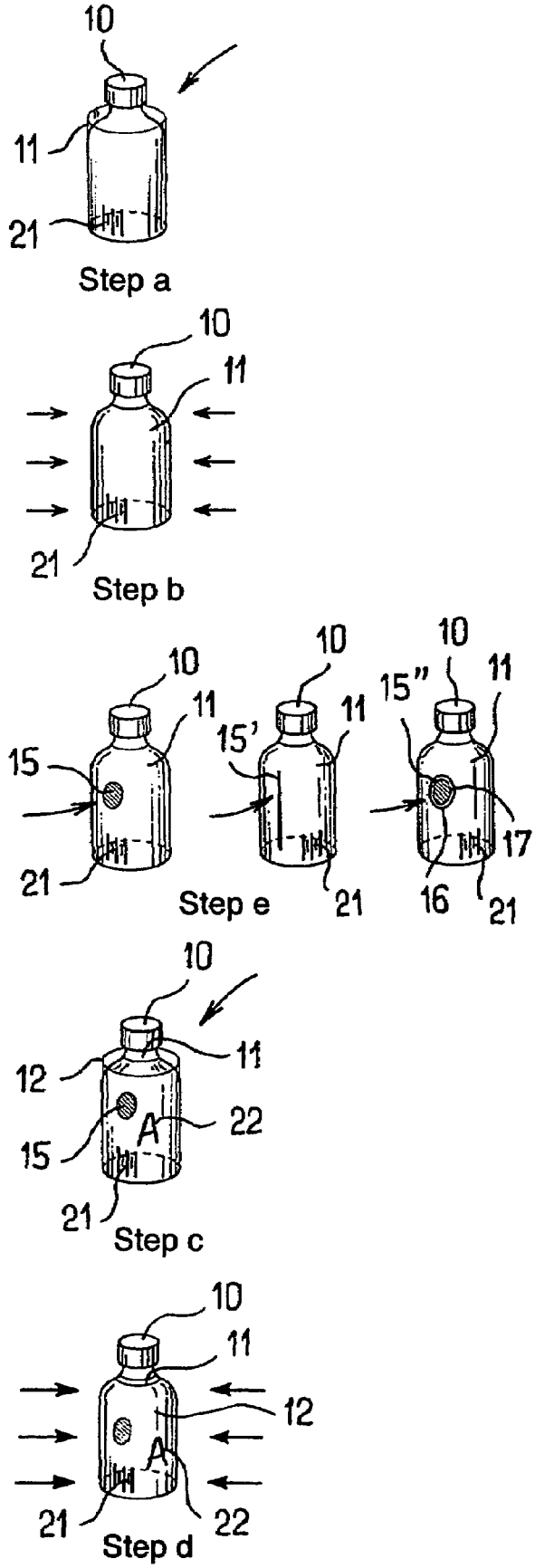
FIG. 2 is a diagram showing a variant of the FIG. 1 method, in which there is provided an intermediate step of putting a functional element into place, and three variants of the intermediate step are shown.

Such a variant of the packaging method is shown diagrammatically in FIG. 2.

Steps a) and b) of the method are the same as described above. The method of FIG. 2 differs from the above method by including an intermediate step e) between above-mentioned steps b) and c), which intermediate step consists in putting a functional element into place against the outside face of the first sleeve 11 shrunk onto the article 10, said functional element subsequently being covered by the second sleeve 12.

In FIG. 2, three implementations of the intermediate step e) are shown, involving placing a functional element 15 or 15' or 15" against the outside face of the first sleeve 11. The functional element 15, 15', or 15" can be held, at least temporarily, by adhesion against the outside of the first sleeve 11, prior to the second sleeve 12 being put into place in the following step c). The functional element 15, 15', or 15" is held definitively by the subsequent shrinkage of the second sleeve 12, as shown at d).

The functional element 15, shown as being formed by a disk, may be an identification or an encoding element. It may thus be a sensor, a chip, a transponder, or a security device against theft or for providing protection against tampering.

The functional element 15' shown as being in the form of an elongate filament is placed to extend along a generator line of the first sleeve 11. By way of example it may constitute an antenna for providing antitheft security or protection against tampering. For techniques providing protection against theft by using an antenna associated with an electronic surveillance system operating on a principle of magnetic detection, reference can be made to document EP-A-0 698 561 in the name of the Applicant.

There is also shown a functional element 15" which is put into place in a housing defined in a localized portion in relief on the wall of the first sleeve 11. As explained below with reference to FIGS. 6 to 8, the first sleeve 11 used during step a) is previously deformed locally by an embossing process so as to generate a predetermined pattern 16 that is associated with the shape of the functional element 15". The embossing process used is such as to ensure that the pattern 15 appears in relief on the outside face of the first sleeve 11 and remains after said first sleeve has shrunk. For such a permanent embossing process, reference can be made to document FR-A-2 841 224 in the name of the Applicant. As shown diagrammatically in this figure, the embossed pattern 16 is circular in shape and is arranged to form a housing 17 for encapsulating the functional element 15".

Once this intermediate step e) has been implemented to receive the functional element 15, 15', 15", or any other equivalent functional element, then the following step c) of putting the second sleeve 12 into place is performed, and finally the step d) of shrinking said second sleeve 12 is performed, without these steps differing from the steps c) and d) of the method of FIG. 1. Nevertheless, shrinking the second sleeve 12 during step d) in this variant of the method produces an additional effect of holding the functional element 15, 15', or 15" in place and of providing it with a covering protecting it against the outside.

It can then be advantageous to provide for the first sleeve 11 also to have a position-identifying pattern (not shown), e.g. colored dots, so as to facilitate positioning the second sleeve 12 circumferentially relative to said first sleeve during step c). In a variant, provision can be made for the first and second sleeves 11 and 12 to present matching embossing (not shown), in particular providing male-female type engagement once the second sleeve 12 has shrunk onto the first sleeve 11, thereby circumferentially indexing said second sleeve relative to said first sleeve.

As mentioned above, it is advantageous to benefit from the presence of two separate sleeves to have each of the two sleeves perform different functions. In particular, it is advantageous to provide for the first sleeve 11 to be printed in order to present printing of a technological nature relating to the identification and/or the traceability of the articles concerned (in particular legal mentioned required in the country in question), while the second sleeve 12 is printed so as to present printing that is decorative or event-based (e.g. a sales promotion or associated with a holiday or a short-term advertising operation), without interfering with the legibility of the printing on the first sleeve 11. These two types of printing are represented diagrammatically in FIGS. 1 and 2 by a bar code 21 representing printing of a technological nature, and a letter "A", referenced 22, representing printing of a decorative nature, the printing 21 being carried by the first sleeve 11 while the printing 22 is carried by the second sleeve 12.

Figure 3:
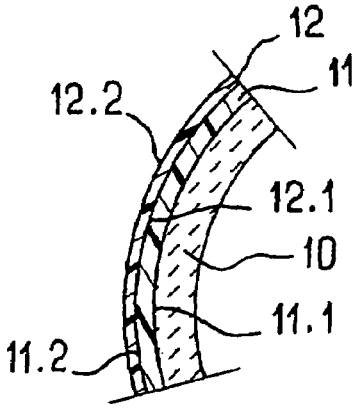
FIG. 3 is a fragmentary section view showing the product obtained at the end of the method shown diagrammatically in FIG. 1.

The fragmentary section of FIG. 3 is on a greatly enlarged scale and serves to distinguish clearly the three successive layers comprising the wall of the article 10, wrapped in the first sleeve 11 shrunk onto the article 10, and in the second sleeve 12 shrunk onto the already-shrunk first sleeve 11. The inner and outer faces respectively of the sleeve 11 are referenced 11.1 and 11.2, and the inner and outer faces respectively of the second sleeve 12 are referenced 12.1 and 12.2. This serves in particular to show clearly how the thermal equilibrium for shrinking the second sleeve 12 relates essentially to the gap between the outer wall 11.2 of the first sleeve 11 that has already been shrunk on, and the inner wall 12.1 of the second sleeve 12 that is about to be shrunk on.

Figure 4:
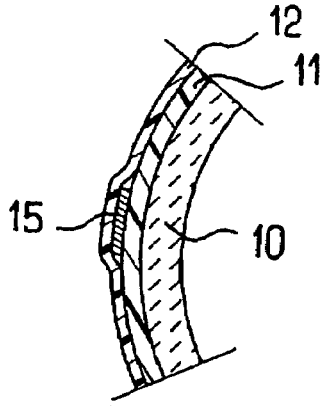
FIGS. 4 and 5 are section views analogous to that of FIG. 3, showing the product obtained at the end of the method shown diagrammatically in FIG. 2.
Figure 5:
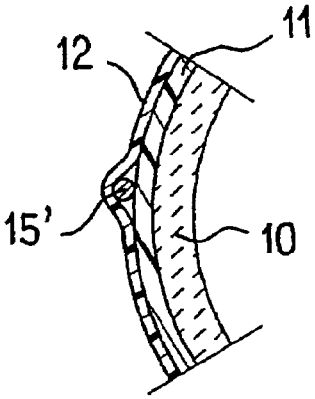

The section of FIG. 4 shows the presence of a functional element 15 held between the two sleeves 11 and 12. The same applies to FIG. 5 which shows the presence of an intermediate functional element 15' in the form of an antenna wire, which is held between the walls of the two sleeves 11 and 12.

Figure 6:
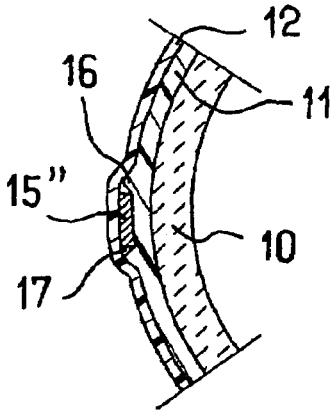
FIG. 6 is a section view showing a functional element that has been inserted as in FIGS. 4 and 5, but with localized embossing of the wall of the first sleeve.
Figure 7:
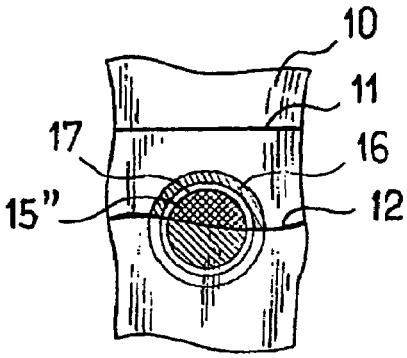
FIG. 7 is a fragmentary elevation view associated with the embodiment of FIG. 6.

FIGS. 6 and 7 correspond to the third variant shown for the intermediate step e), with a functional element 15" being put into place in a specific housing provided in the wall of the first sleeve 11. It can be seen that the first sleeve 11 presents an embossed portion 16 forming a pattern in relief on the outside face of said first sleeve, which pattern is arranged in association with the shape of the functional element 15", and specifically to be circular in shape. The embossed rim forming the embossed portion 16 forms a kind of crater which defines a housing 17 for encapsulating the functional element 15". Before the second sleeve 12 is put into place, and if so desired, it is possible to ensure that the functional element 15" is held securely in place by sticking said functional element against the outside face of the first sleeve 11 in the bottom of the associated housing 17. In any event, once the second sleeve 12 has been put into place and shrunk on, its wall will finish off encapsulating the functional element 15" so as to ensure that it cannot become lost and so as to protect it against any external attack that might harm its function.

Figure 8:
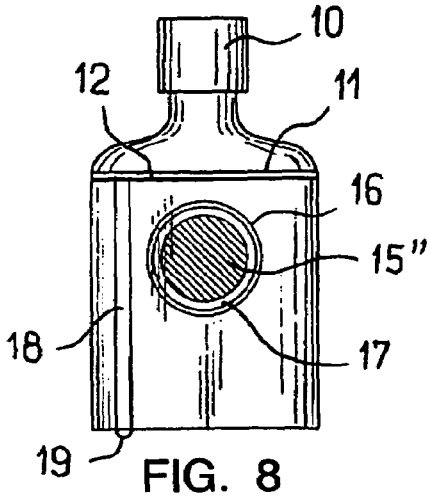
FIG. 8 is a complete elevation view showing the presence of a tear strip enabling the second shrunk-on sleeve to be removed, and consequently giving access to the functional element associated with the first sleeve.

Provision can be made for the functional element 15" to be part of a promotion, for example it may be a coin or a medal. Under such circumstances, and as shown in FIG. 8, it can be advantageous to provide for the second sleeve 12 to present a tear strip 18 so as to enable said second sleeve to be removed, and consequently gives access to the functional element 15". Specifically, the tear strip 18 which presents a bottom pull tab 19 is disposed axially, i.e. along a generator line of the sleeve 12, however it would naturally also be possible in a variant to provide a tear strip that extends circumferentially.

In general, provision should be made for the first and second sleeves 11 and 12 to be substantially identical in axial height. If they are significantly different in height, then it is the second sleeve 12 that should be the shorter sleeve so as to enable it to be shrunk on quickly and under control.

Provision can be made for the first and second sleeves 11 and 12 to differ from each other in thickness and/or in the nature of their constituent films. In a variant, the first and second sleeves 11 and 12 could be made from constituent films of the same nature and of the same thickness.

In practice, it is the first of the two above possibilities that is the most advantageous insofar as it makes distinct choices possible, for example the first sleeve may be constituted by a relatively thick multilayer film, while the second sleeve 12 may be made from a thinner single-layer film, or vice versa. In particular, it is possible to use a multilayer film presenting at least three layers, with a central layer that has barrier properties, in particular a cellular layer forming a thermal barrier. This provides a very advantageous function of retarding heating, both during shrinking and after shrinking so as to avoid heating the product contained in the article.

It should be observed that the presence of the first sleeve 11 also makes it possible to optimize sliding for putting into place and shrinking-on the second sleeve 12.

Provision can also be made to at least one of the first and second sleeves 11 and 12 to present optical effects, in particular holographic effects.

In any event, because of the presence of two superposed sleeves, it is possible to wrap containers that are cold or even very cold, and/or full, and it is also possible to create a thermal bridge serving in particular to conserve a liquid at a desired temperature for longer.

The invention is not limited to the various embodiments described above, but on the contrary covers any variant using equivalent means to reproduce the essential characteristics specified above.

For example, provision can be made for other functional elements to be sandwiched between the two sleeves 11 and 12, such as hologram ribbons, thereby providing a function dedicated specifically to authenticating the article and making it tamperproof.

Provision could naturally also be made for simultaneously using a plurality of functional elements of the kinds described.

Finally, for the second or outer sleeve 12, it is possible to apply one or other of the techniques already put forward by the Applicant for use with a single shrink-on sleeve, for example techniques involving an additional flap that can be torn off completely or in part.

Finally, a lenticular arrangement can be provided with a crossed structure arranged on the second sleeve 12 to hide or reveal all or part of the text present on the first sleeve 11, also with the possibility of organizing animation and/or encoding.

While the present invention has been illustrated and described with respect to a particular embodiment thereof, it should be appreciated by those of ordinary skill in the art that various modifications to this invention may be made without departing from the spirit and scope of the present invention.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method of packaging one or more articles, the method comprising the steps of:

a) putting a first sleeve of heat-shrink material into place on the article(s) to be packaged;

b) using a thermal process to shrink the first sleeve onto said article(s);

c) putting a second sleeve of heat-shrink plastics material on the article(s) covered in said shrunk-on first sleeve; and d) using a thermal process to heat the gap between an outer wall of the first sleeve and an inner wall of the second sleeve until thermal equilibrium is substantially obtained between the outer wall of the first sleeve and the inner wall of the second sleeve, and then shrinking said second sleeve onto said first sleeve.

2. The method according to claim 1, including an intermediate step e) between above-specified steps b) and c), the intermediate step comprising putting a functional element into place against the outside face of the first sleeve shrunk onto said article(s), said functional elements then being covered by the second sleeve.

3. The method according to claim 2, wherein the first sleeve used during step a) is previously deformed locally by an embossing process to have a predetermined pattern in association with the shape of the functional element, said embossing process being such that said pattern appears in relief on the outside face of the first sleeve and remains after said first sleeve has been shrunk.

4. The method according to claim 3, wherein the embossed pattern is arranged to form a housing for encapsulating the functional element.

5. The method according to claim 2, wherein the functional element is held at least temporarily by being stuck against the outside face of the first sleeve before the second sleeve is put into place, with said functional element being held finally in place by the subsequent shrinking of said second sleeve.

6. A packaging method comprising steps of:

heat-shrinking a first sleeve of plastic material onto at least one article;

allowing the at least one article to cool;

placing a second sleeve of plastic material around the at least one article; and heat-shrinking the second sleeve of plastic material onto the at least one article after heating the gap between an outer wall of the first sleeve and an inner wall of the second sleeve, to substantially achieve thermal equilibrium between said outer wall of the first sleeve and said inner wall of the second sleeve;

wherein the heating to thermal equilibrium is done without substantially heating the at least one article.

7. The method of claim 6, wherein the at least one article is a container and the method further comprises adding contents to the container prior to heat-shrinking the second sleeve of plastic material.

8. The method of claim 7, wherein the contents of the container are below ambient temperature prior to heat-shrinking the second sleeve of plastic material.

9. The method of claim 7, wherein the contents of the container include a carbonated liquid.

* * * * *